US006234923B1

(12) United States Patent
Gentile

(10) Patent No.: US 6,234,923 B1
(45) **Date of Patent: *May 22, 2001**

(54) STREET HOCKEY STICK

(76) Inventor: Robert Gentile, 30 Wyman Rd., Billerica, MA (US) 01821

( * ) Notice: Subject to any disclaimer, the term of this patent is extended or adjusted under 35 U.S.C. 154(b) by 0 days.

This patent is subject to a terminal disclaimer.

(21) Appl. No.: 09/400,040

(22) Filed: Sep. 21, 1999

(51) Int. Cl.[7] ..... A63B 59/12
(52) U.S. Cl. ..... 473/563
(58) Field of Search ..... 473/560–563

(56) References Cited

U.S. PATENT DOCUMENTS 3,489,412 * 1/1970 Franck et al. ..... 473/563
5,429,352 * 7/1995 Leclerc ..... 473/563
5,558,326 * 9/1996 Adamson et al. ..... 473/563
5,697,857 * 12/1997 Christian et al. ..... 473/563
5,836,841 * 11/1998 Fell ..... 473/563
5,839,977 * 11/1998 Maurer et al. ..... 473/560
5,980,404 * 11/1999 Gentile ..... 473/560

* cited by examiner

*Primary Examiner*—Mark S. Graham
(74) *Attorney, Agent, or Firm*—O'Connell Law Firm

(57) ABSTRACT

A hockey blade for a hockey stick for striking a game projectile during hockey play. The preferred hockey blade has horizontal arcuate channels disposed on each of a first striking face and a second striking face of a projectile striking member whereby the striking faces of the hockey blade demonstrate improved control over a spherical game projectile. A plurality of vertical score lines may be disposed on one or both striking faces of the hockey blade. The upper and lower edges of the horizontal arcuate channels may be displaced from the upper and lower edges of their respective striking faces, and the vertical score lines may be located only in the horizontal arcuate channels.

14 Claims, 5 Drawing Sheets

STREET HOCKEY STICK

FIELD OF THE INVENTION

The present invention relates generally to sports devices. More specifically, disclosed and protected by the present patent is a street hockey stick for striking a game projectile during street hockey play.

BACKGROUND OF THE INVENTION

Prior art hockey sticks essentially comprise a handle coupled to a blade. The handle and blade may be formed integrally as a single unit, or the two may be disengagably coupled by a male/female connection. Hockey stick handles and hockey blades can be crafted from a wide variety of materials including laminated wood, plastic, aluminum, graphite, and composite materials such as fiberglass. Standard hockey blades may be either neutral or curved. Neutral hockey blades are substantially straight while curved hockey blades display a longitudinal concave curve on a forehand striking face and a corresponding longitudinal convex curve on an opposite backhand striking face. Such traditional curved hockey stick blades have been noted to enjoy added control from the forehand striking face but suffer from reduced control on the backhand striking face.

Relatively recent improvements in hockey sticks disclose hockey stick blades with longitudinal concave curves on both the forehand striking face and the backhand striking face. (See, e.g., U.S. Pat. No. 5,582,405 to Montgomery.) Other hockey stick blades have been disclosed that have bifurcated toe portions whereby both striking faces present a longitudinal concave curve. (See, e.g., U.S. Pat. No. 4,799,682 to Hughes.) These and other devices are said to improve a player's control of a hockey puck on both the forehand and backhand striking faces.

In recent years, however, hockey sports wherein the game projectile is a ball instead of a puck have become increasingly popular. Present-day street hockey is played not only on streets but also in specially constructed indoor rinks. Furthermore, the more recently developed sport of roller hockey continues to grow in popularity. Unfortunately, hockey sticks have failed to adapt to these hockey sports wherein the game projectile is spherical instead of flat and round. Furthermore, hockey sticks have not satisfactorily addressed the change in playing surface from ice to wood, pavement, or cement.

For example, the vertically flat striking faces of present day hockey sticks may be ideal for striking a flat-edged hockey puck, but they exhibit a number of disadvantages when employed to play hockey with a spherical hockey ball. One major disadvantage is exhibited when a player seeks to stop a moving ball because a hockey ball tends to roll and not to slide as does a hockey puck. As a result, hockey balls rolling along a playing surface with significant rotary kinetic energy often climb up and roll over the striking face of the hockey blade whereby the player controlling that stick is unable to stop the ball. Furthermore, players using a stick with a vertically flat striking face often find it difficult to direct a vertically bouncing ball toward the ground where it can be controlled and struck. Still further, roller hockey and street hockey players often find that hockey blades with vertically flat striking faces often wedge a ball between the ground and the stick face when a player attempts to strike the ball such as in a slap shot.

Even further still, it is often difficult for hockey players to control a hockey ball as they strike it. Hockey players certainly can wrap their hockey stick blades in fabric tape to attempt to control a hockey ball. However, doing so is problematic for a number of reasons. For example, although the high friction characteristics of the fabric tape advantageously allow a player to deaden a ball upon impact as upon receiving a pass or the like and to impart spin and control to the hockey ball when passing or the like, those same frictional characteristics disadvantageously tend to prevent a hockey ball in contact with the stick from rolling freely relative to the stick blade. With this, hockey blades employing such friction tape have a marked tendency to wedge or trap hockey balls during hockey play. Also, the friction tape tends to interfere with the smooth progress of the hockey stick blade over a playing surface. Furthermore, unlike the smooth ice surfaces on which ice hockey is played, the abrasive surfaces on which roller hockey is played tend to damage the wrapped tape rapidly thereby demanding its replacement or discouraging its use.

One fully knowledgeable in the art will be aware that certain inventors have attempted to provide a hockey stick blade that enables control of a game projectile without a need for fabric tape being wrapped around the blade. For example, in U.S. Pat. No. 5,836,841, Fell describes a hockey stick blade that has a fascia attached to its surface for improving control over a game projectile. Although a number of different embodiments of the invention are disclosed, each embodiment can be seen to have a plurality of ridges disposed on its surface. The patent teaches that "the ridges temporarily 'catch' or impede the progress of the puck or ball along the blade as well as up and down the blade, thus providing for increased control."

Assuming the foregoing to be true, devices embodying Fell's invention nonetheless suffer from a number of disadvantages. For example, the ridges on the control fascia are subject to damage during use of the hockey blade thereby diminishing the effectiveness of the invention. Furthermore, the ridges, which jut above the surface of the hockey blade, can inflict damage on a game projectile, such as a street hockey ball, thereby limiting the useful lifespan of the ball. Still further, the projecting ridges of the control fascia can cause shots with the hockey blade to be unpredictable as the precise direction of the game projectile will depend on the manner in which the game projectile strikes an upstanding ridge. Of course, this is highly undesirable when one is attempting to make an accurate pass or shot. Even further, as Fell's patent expressly indicates, the ridges, particularly the horizontally disposed ridges, can catch or impede the progress of the ball in a manner that can trap or wedge the ball thereby interrupting hockey play.

With these things in mind, it becomes clear that there remains a need in the sport for a hockey stick blade that provides for improved control over a game projectile while demonstrating durability, simplicity, and accuracy while not tending to inflict damage on a game projectile, such as a hockey ball.

SUMMARY OF THE INVENTION

In light of the above-described state of the prior art, a few objects and advantages of the present invention are worth particular mention.

For example, it advantageously is a principal object of the present invention to provide a hockey blade for a hockey stick that is particularly adapted for use with a spherical hockey ball.

The invention also is intended to improve a hockey player's ability to stop and control a hockey ball including allowing the player to induce a lateral spin in a hockey ball.

A further object of the invention is to provide a hockey blade that accomplishes the foregoing while remaining durable in use and simple in construction.

Another object of the invention is to provide a hockey blade that meets each of its remaining objects while not tending to inflict damage on a game projectile and while allowing for undiminished accuracy in shooting and passing.

The invention also strives to provide a hockey blade that simulates the activity of a vertically-curved snowplow blade as it produces a wave of snow to cause the inventive hockey blade to induce a hockey ball to roll as it is pushed and struck by the hockey blade thereby producing a number of benefits including added control and a reduction in the likelihood that a hockey ball will become wedged between the hockey blade and the ground.

The invention is designed to provide the aforementioned benefits on both striking faces of a hockey blade even where the blade demonstrates a longitudinal curve.

The invention also seeks to enable a hockey player to attract attention to the hockey player's hockey stick selectively and to attract attention to the hockey player's stick automatically when the hockey blade experiences an impact (i.e., when a player strikes a ball or the playing surface with the hockey stick).

A related object of the invention is to enable other hockey player's to distinguish readily between a first striking face and a second striking face of the hockey stick.

Certainly, these and other objects and advantages of the present invention will become obvious to one who reads this specification and reviews the accompanying drawings.

In accomplishing the aforementioned objects, the present invention for a hockey blade essentially comprises an elongate projectile striking member with a first striking face with an upper edge and a lower edge, a second striking face with an upper edge and a lower edge, and a horizontal arcuate channel defined by an upper edge and a lower edge disposed on at least a portion of the first striking face. In a preferred embodiment, the upper edge of the arcuate channel is coincident with the upper edge of the first striking face, and the lower edge of the arcuate channel is coincident with the lower edge of the first striking face.

Although such an embodiment of the invention accomplishes a number of the objects of the invention, greater advantage can be achieved by disposing a horizontal arcuate channel on the second striking face whereby both striking faces will provide a player with added control over the hockey ball. The projectile striking member may be straight with the upper edges of both arcuate channels coincident with the upper edges of the respective striking faces and both lower edges of the arcuate channels coincident with the lower edges of respective striking faces. Alternatively, the projectile striking member may be horizontally curved in which case the upper and lower edges of the arcuate channel on the first striking face may be coincident with the upper and lower edges of the first striking face while the upper edge of the arcuate channel on the second striking face is below the upper edge of the second striking face and the lower edge of the arcuate channel on the second striking face is above the lower edge of the second striking face. Under such an arrangement, the invention is able to provide improved handling of a street hockey ball on both sides of the striking member while not requiring unwieldy thickness that might be required if both curves started at the edges of the striking faces.

In certain embodiments, the projectile striking member may have an arcuate channel disposed on the first striking face that has upper and lower edges displaced from the upper and lower edges of the first striking face. An arcuate channel on the second striking face may or may not be included in such an embodiment.

Further control can be realized by disposing a plurality of vertical score lines on at least the first striking face. Advantageously, the vertical score lines allow a player to introduce a lateral spin to the ball while not resisting or slowing down forward movement of the ball as might texturing or knurling. Where the edges of the arcuate channel are displaced from the upper and lower edges of the first striking face, the vertical score lines may preferably be disposed only in the portion of the first striking face that comprises the arcuate channel. The area of the first striking face between the upper edge of the arcuate channel and the upper edge of the first striking face and the lower edge of the arcuate channel and the lower edge of the first striking face may be smooth since it typically will have less contact with a game ball during hockey play. Of course, where an arcuate channel is disposed on the second striking face, it is possible to have vertical score lines disposed only in that arcuate channel as well.

By providing vertical score lines as opposed to protruding ridges as has been done in the prior art, the present invention achieves a number of advantages. For example, the street hockey blade demonstrates an increased ability to stop and control a hockey ball including allowing the player to induce a lateral spin in a hockey ball. However, with vertical score lines that essentially comprise elongate depressions in the first and second striking faces, the invention accomplishes the foregoing without tending to inflict damage on a game projectile as would be likely to occur with the raised ridges employed by the prior art. As such, the vertical score lines of the present invention as compared to the ridges of the prior art can be equated to the furrows in an automobile tire as compared to studs applied to an automobile tire. While the raised ridges and the studs on an automobile tire comprise projections beyond the peripheral surface of their respective articles, the vertical score lines and the furrows on an automobile tire comprise portions that are below the peripheral surface of their respective articles. With this, the raised ridges and studs on a tire comprise disruptive projections while the vertical score lines and the furrows on an automobile tire do not disrupt the peripheral surfaces of their articles. Nonetheless, the vertical score lines and the furrows on an automobile tire accomplish their intended functions, namely, enabling control of a game projectile and improving traction on a road surface respectively. Furthermore, unlike the raised ridges of the prior art, the vertical score lines of the present invention do not detract from the ability of the street hockey blade to shoot and pass accurately.

Since the hockey blade of the present invention is particularly designed for use with street hockey balls, at least the first striking face of an ideal hockey blade will have a horizontal arcuate channel with a horizontal midline that is approximately the same height as the midline of a street hockey ball. Since standard street hockey balls are approximately 2.6 inches in diameter, a preferred arcuate channel will have a horizontal midline that is between approximately 1 and 1.5 inches above the lower edge above the lower edge of the first striking face while an ideal arcuate channel will have a horizontal midline that is approximately 1.3 inches above the lower edge of the first striking face.

The preferred embodiment of the street hockey blade also accommodates the change in playing surface from ice to other surfaces such as pavement or cement. Although traditional hockey stick blades slide effortlessly over ice, other playing surfaces provide disadvantageous resistance to movement of the street hockey blade thereover. Advantageously, the present invention reduces this resistance by providing a plurality of ridges disposed on a bottom face of the hockey blade that act to reduce surface contact between the street hockey blade and a playing surface on which the blade is used. Although the ridges may be formed integrally with the projectile striking member, they alternatively may be formed of a different material. For example, the ridges may comprise spherical balls that are rotatably retained on the bottom face of the projectile striking member. Furthermore, the ridges may be formed of a material of increased durability and which demonstrates a low coefficient of friction relative to a playing surface. For example, the ridges may comprise hard plastic or metal ball bearings.

To attract attention to the hockey blade during hockey play, a first light source along with a power source therefor may be operably associated with the hockey blade. The hockey blade may include further a means for automatically activating the first light source in response to an impact on the hockey blade, and there may additionally or alternatively be included a means for selectively activating the first light source. Such an arrangement provides a number of benefits. For example, a player can strike the stick against a playing surface to activate the first light source and to indicate that he or she, for example, is open to receive a pass. Furthermore, the first light source will be activated when a player strikes a game projectile whereby other players are immediately alerted that the game projectile has been struck.

Although one light source certainly provides a number of heretofore unrealized advantages, the inventor has discovered that including a second light source and disposing the first and second light sources on opposite first and second sides of the hockey blade provides still further advantage. For example, the first and second light sources can emit different light signals (i.e., different colors) so that another player can readily determine which side of the stick he or she is viewing. The light source and power source may be fixedly coupled with the hockey stick blade (i.e., retained therewithin except for the light source), or the means for coupling the first light source and the power source to a hockey stick may comprise any appropriate means such as glue, tape, or a band for surrounding a portion of a hockey stick.

The foregoing discussion broadly outlines the more important features of the invention to enable a better understanding of the detailed description that follows and to instill a better appreciation of the inventor's contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As with many inventions, the present invention for a street hockey blade can assume a wide variety of embodiments. However, to assist those reviewing the present disclosure in understanding and, in appropriate circumstances, practicing the present invention, a preferred embodiment of the instant invention for a street hockey blade will be disclosed hereinafter.

Figure 1:
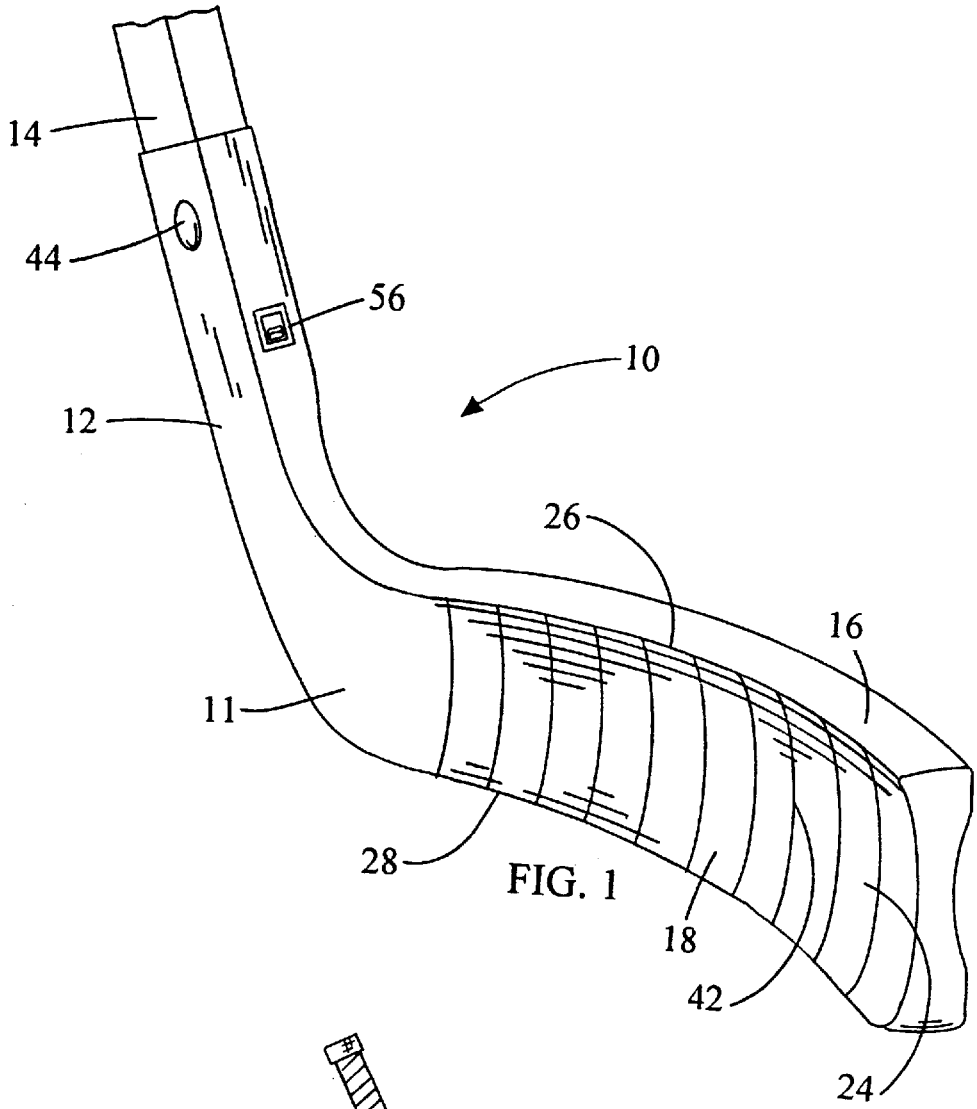
FIG. 1 is a perspective view of a street hockey blade embodying the present invention shown coupled to a hockey stick handle.
Figure 2:
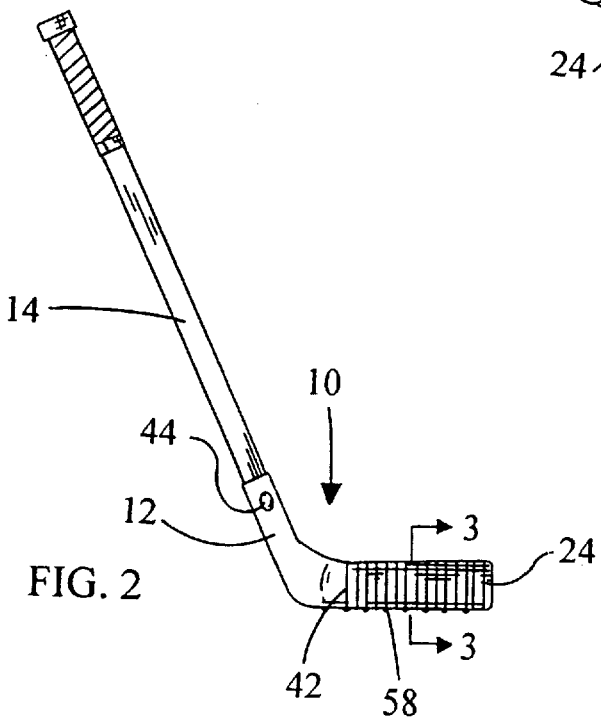
FIG. 2 is a view in front elevation of the street hockey blade of FIG. 1.

Looking more particularly to the drawings, FIG. 1 shows a street hockey blade 12 embodying the present invention. The street hockey blade 12 is coupled to a hockey stick handle 14 whereby the street hockey blade 12 and the hockey stick handle 14 together comprise a street hockey stick 10. The street hockey blade 12 includes an elongate projectile striking member 16 that has a first striking face 18 and a second striking face 20, which can be seen most clearly in FIG. 4. As is commonly found in the prior art, the projectile striking member 16 of the embodiment of the invention shown in FIGS. 1–4 is horizontally curved to suit a particular hand dominance such that the first striking face 18 presents a forehand side 18 and the second striking face 20 presents a backhand side 20.

It should be made clear that although the street hockey blade 12 and the hockey stick handle 14 are shown as matingly engaged in the preferred embodiments of the invention disclosed herein, it is certainly within the scope of the present invention to form the street hockey blade 12 and the hockey stick handle as an integral unit. It also should be made explicit at the outset that throughout the present specification and claims spatial indications shall be used assuming that the street hockey stick 10 is in an upright position in the figures. Consequently, such words as "upper" shall mean above in location in the figure, and such words as "lower" shall mean below in location in the figure.

With this in mind and looking to the embodiment of the invention shown in FIGS. 1–4, one sees that the first striking face 18 of the present street hockey blade 12 is not vertically flat as are striking faces found in prior art hockey stick blades (not shown). Instead, the first striking face 18 has a vertical curve 22 disposed over substantially its entire length that thereby forms a horizontal arcuate channel 24. The horizontal arcuate channel 24 has an upper edge 26 that is coincident with an upper edge of the first striking face 18, which also is indicated at 26. Similarly, a lower edge 28 of the horizontal arcuate channel 24 also is coincident with a lower edge 28 of the first striking face 18.

Figure 3:
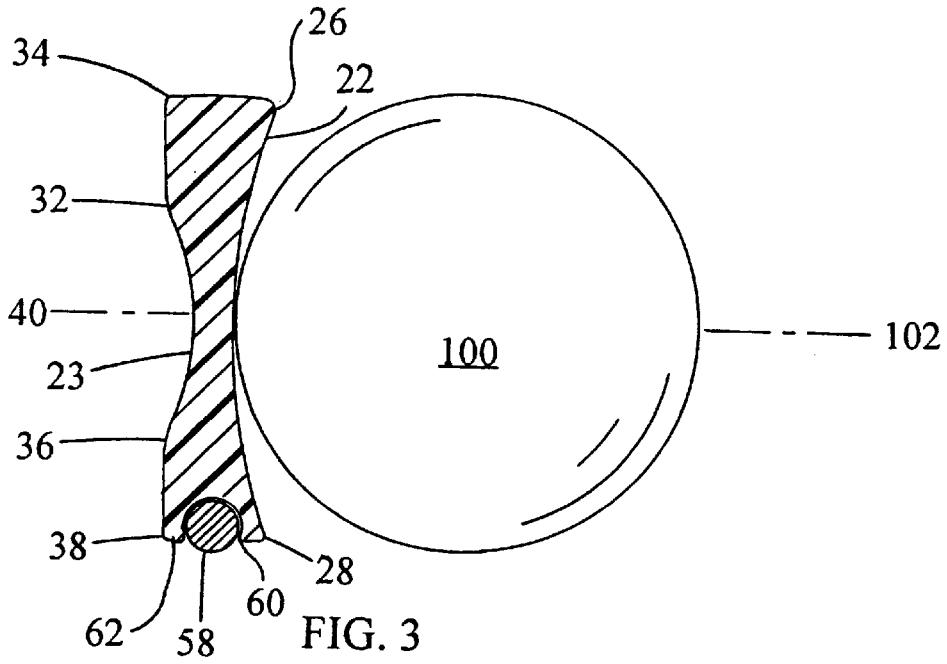
FIG. 3 is a view in cross section of a street hockey blade according to the present invention taken along the line 3—3 in FIG. 2 shown adjacent to a standard street hockey ball.
Figure 4:
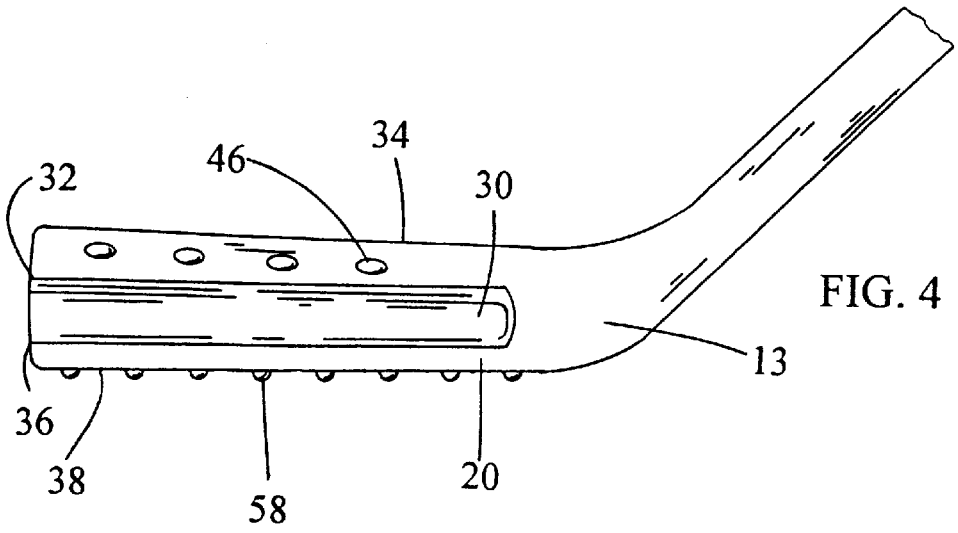
FIG. 4 is a view in rear elevation of the street hockey blade of FIG. 1.

As FIGS. 3 and 4 show most clearly, the second striking face 20 of the projectile striking member 16 has a vertical curve 23 disposed over substantially its entire length that thereby forms a horizontal arcuate channel 30. Unlike the horizontal arcuate channel 24 of the first striking face 18, the horizontal arcuate channel 30 of the second striking face 20 has an upper edge 32 that is below the upper edge 34 of the second striking face 20, and a lower edge 36 that is above a lower edge 38 of the second striking face 20.

Of course, variations in the relative locations of the upper and lower edges 26, 32, 28, and 36 of the horizontal arcuate channels 24 and 30 are well within the scope of the present invention. For example, one may look to FIG. 5 where an alternative embodiment of the invention is shown in cross section. In that embodiment, the projectile striking member 16 is straight whereby the street hockey blade 12 is suitable for players of either hand dominance and the striking faces 18 and 20 may be used equally. Consequently, the first and second striking faces 18 and 20 have substantially identical vertical curves 22, 23 that define the horizontal arcuate channels 24, 30. Each arcuate channel 24, 30 has an upper edge 26, 32 that is coincident with the upper edge 26, 34 of the first striking face 18 and the second striking face 20, and each arcuate channel 24, 30 has a lower edge 28, 36 that is coincident with the lower edge 28, 38 of first striking face 18 and the second striking face 20.

Each of the horizontal arcuate channels 24 and 30 has a horizontal midline 40 about which the horizontal arcuate channels 24 and 30 are substantially symmetrical. Since the street hockey blade 12 is particularly adapted for use with a street hockey ball such as that shown at 100 in FIG. 3, the horizontal midlines 40 of these most preferred embodiments are approximately equal in height as the midline 102 of the street hockey ball 100. Consequently, the first striking face 18 and the second striking face 20 add to a player's control over a street hockey ball 100 while tending to hit a ball squarely and neither pressing the street hockey ball 100 downward nor unintentionally causing the street hockey ball 100 to lift. With this in mind and since standard street hockey balls 100 have a diameter of approximately 2.6 inches and thus a horizontal midline 102 that is approximately 1.3 inches above a playing surface (not shown), the horizontal midlines 40 of the horizontal arcuate channels 24 and 30 also are approximately 1.3 inches above the lower edges 28 and 38 of the first and second striking faces 18 and 20 and thus a playing surface. Furthermore, in this preferred embodiment, each vertical curve 22, 23 (and consequently the arcuate channels 24 and 30) has a generally consistent radius of curvature that is greater than the 1.3 inch radius of curvature of a standard street hockey ball 100. As a result, a street hockey ball 100 can be cupped and controlled by the arcuate channels 24 and 30 without being wedged or trapped therein. Of course, where other game projectiles are used, it may be preferable to vary the radius of curvature accordingly.

By the provision of the horizontal arcuate channels 24 and 30, the present street hockey blade 12 certainly provides a player who plays with a spherical street hockey ball 100 with improved control over prior art hockey sticks. However, the present invention provides a player with still greater control over a game projectile such as the street hockey ball 100, by the provision of a plurality of vertical score lines 42 disposed on at least the first striking face 18. The plurality of vertical score lines 42 allow a player to induce a lateral spin on a game projectile such as the street hockey ball 100. Advantageously, however, they do not interfere with the forward progress of a street hockey ball 100 as would surface texturing or knurling.

Figure 5:
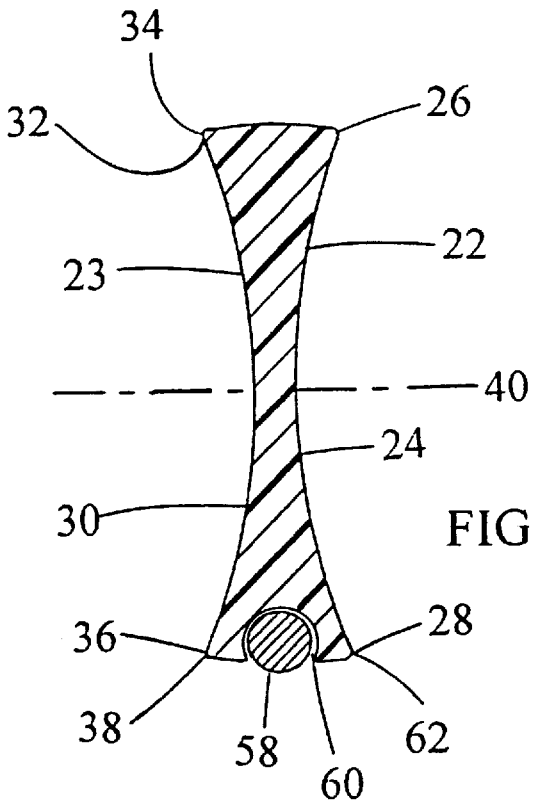
FIG. 5 is a view in cross section of an alternative street hockey blade according to the present invention.
Figure 8:
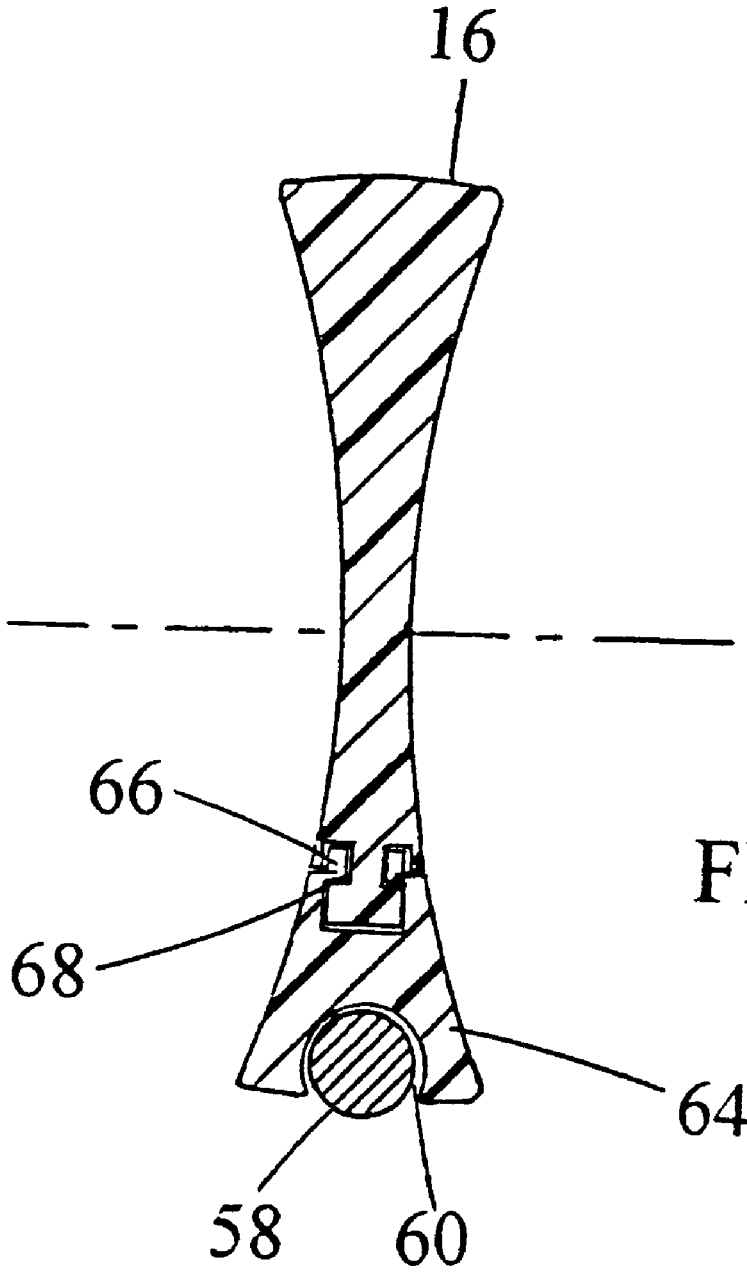
FIG. 8 is a view in side elevation of another alternative street hockey blade according to the present invention.

Advantageously, as FIGS. 3, 5, and 8 show most clearly, the present invention further comprises a plurality of ridges, each comprising a spherical ball 58, disposed on a bottom face 62 of the projectile striking member 16. The spherical balls 58 reduce resistance to movement of the street hockey blade 12 over a non-illustrated playing surface on which the hockey stick 10 is used by rolling over the playing surface and reducing surface contact area. Each spherical ball 58 is rotatably retained on the bottom face 62 of the projectile striking member 16 within a cavity 60. The spherical balls 58 may be formed of any suitable material. For example, for increased durability and reduced frictional resistance, the spherical balls 58 may be formed of a hard plastic or a metal. Nonetheless, it is likely that the spherical balls 58 or any other type of ridge would demonstrate wear after a certain amount of use. With this in mind, another embodiment of the invention, which is shown in FIG. 8, shows the spherical balls 58 to be retained by a sleeve 64 that forms a removably coupled bottom portion of the projectile striking member 16 by employing a slidable connection between a pair of opposed ridges 66 on the sleeve 64 and a pair of corresponding opposed grooves 68 in the projectile striking member 16.

These most preferred embodiments of the present street hockey stick 10 further include a first light source 44 disposed on a first side 11 of the street hockey blade 12 and a second light source 46 disposed on a second side 13 of the street hockey blade 12. Each of the first and second light sources 44 and 46 comprises at least one shielded bulb. Certainly, either or both light sources 44 or 46 may comprise a multiplicity of shielded bulbs. Although in the embodiment of the invention shown in FIGS. 1, 2, and 4 the first light source 44 and the second light source 46 are shown to be embedded within the street hockey blade 12, certainly it is within the scope of the present invention to attach the first light source 44 and the second light source 46 by any appropriate means such as a band 48 with a hook and loop attaching mechanism 50 as is shown in FIGS. 6 and 7.

Figure 6:
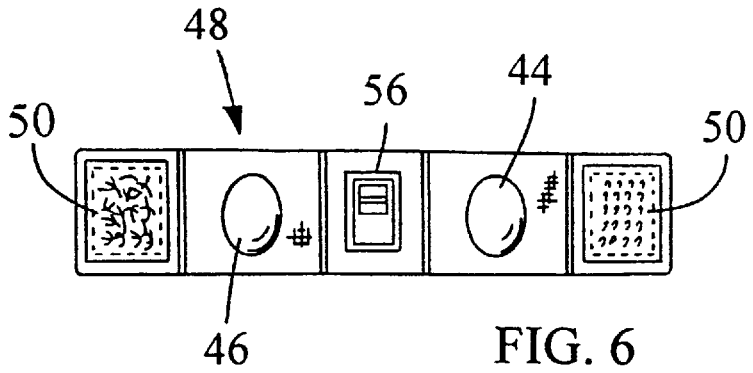
FIG. 6 is a view in front elevation of a device according to the present invention for causing a hockey stick to emit light for attracting attention to the hockey stick during hockey play.
Figure 7:
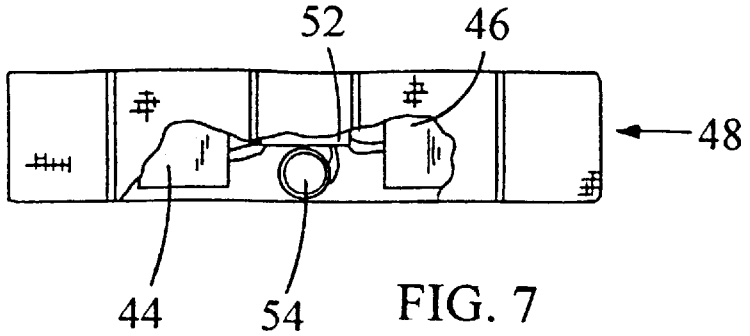
FIG. 7 is a partially sectioned view in rear elevation of the device of FIG. 6.

Since in each embodiment the mechanisms for activating the first and second light sources 44 and 46 are substantially the same and since a majority of the mechanism is formed within the hockey stick blade 12 in FIGS. 1–5, one may look most conveniently for an understanding of the lighting arrangement of the present invention to FIG. 6 and to FIG. 7 where the band 48 is partially sectioned away to reveal a printed circuit board 52 that is contained therewithin. A battery 54 is operably coupled to the circuit board 52 and to the first and second light sources 44 and 46 to act as a power source therefor. A means for automatically activating the first and second light sources 44 and 46 in response to an impact on the hockey blade 12 is operably coupled to the first and second light sources 44 and 46.

In this embodiment, the means for automatically activating the first and second light sources 44 and 46 is incorporated into the circuit board 52. However, the means for automatically activating the first and second light sources 44 and 46 may be of any of the designs that are now or may come to be known to the art. For example, the automatic activating means may be modeled after that disclosed in U.S. Pat. No. 5,066,011 for a Flashing Light Ball, U.S. Pat. No. 5,236,383 for a Illuminated Toy Ball, or U.S. Pat. No. 5,408,764 for a Motion Activated Illuminating Footwear and Light Module Therefor. Therefore, each of these disclosures is expressly incorporated herein by reference. However, since a player may wish for the first and second light sources 44 and 46 to be continuously activated during hockey play, the invention further includes an on/off switch 56 that is operably coupled to the first and second light sources 44 and 46 whereby the on/off switch 56 acts as a means for selectively activating the first and second light sources 44 and 46.

It is most preferable that the first and second light sources 44 and 46 emit different light signals when activated whereby other players may be able to determine which side 11 or 13 of the hockey blade 12 is facing them. As a result, in these most preferred embodiments, the first light source 44 emits a light signal of a first color (i.e., green) while the second light source 46 emits a light signal of a second color (i.e., red). However, it should be clear that the term different light signals does not require that the first and light sources 44 and 46 emit different colors. For example, it would provide sufficient differentiation if the first and second light sources 44 and 46 were of different shapes or if one or each comprised a multiplicity of bulbs arranged in different configurations even if the first and second light sources 44 and 46 emitted light of the same color. For example, one sees that the first light source 44 comprises a single bulb in a given position in FIG. 1 while the second light source 46 comprises a multiplicity of light bulbs in a different position in FIG. 4. Any sufficient difference in light signal characteristic, number, or location would be sufficient to allow a player to differentiate between the first light source 44 and the second light source 46. Consequently, the term different light signal should be considered to include any sufficient difference in light signal that would allow differentiation between the first and second sides 11 and 13 of the street hockey blade 12.

Figure 9:
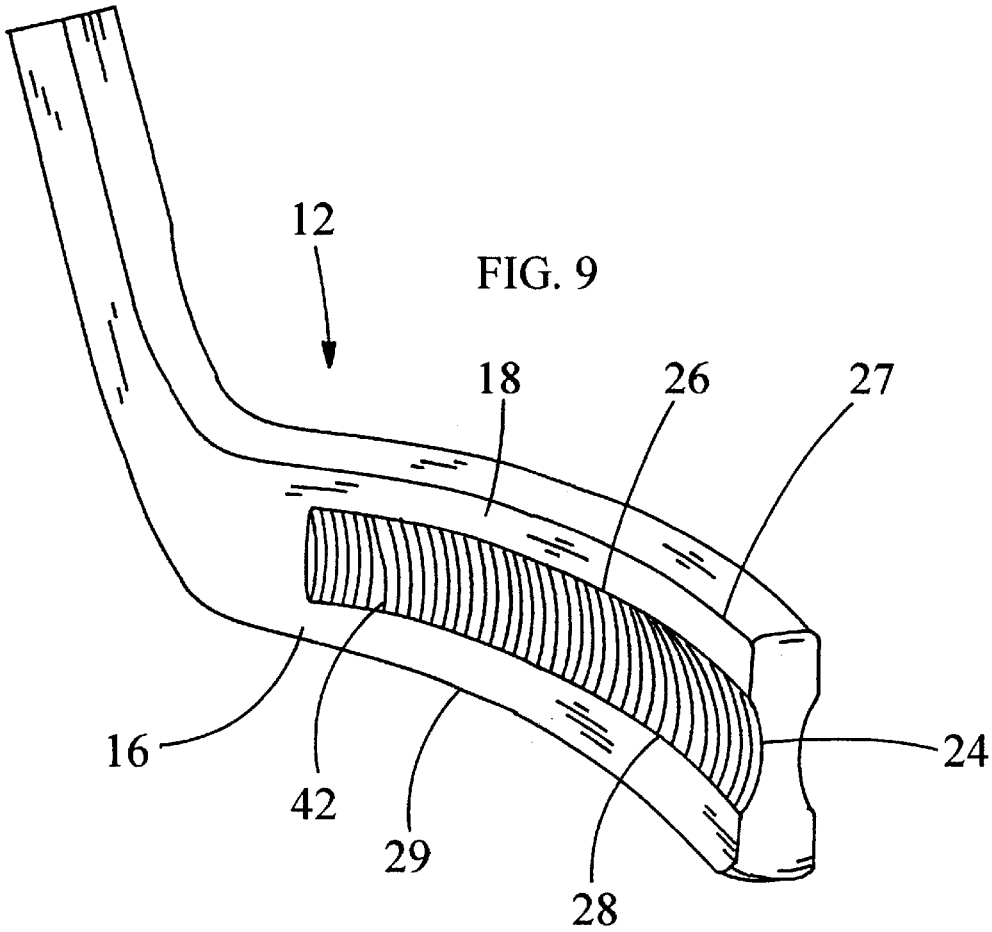
FIG. 9 is a view in front elevation of a further embodiment of the present invention for a street hockey blade.
Figure 10:
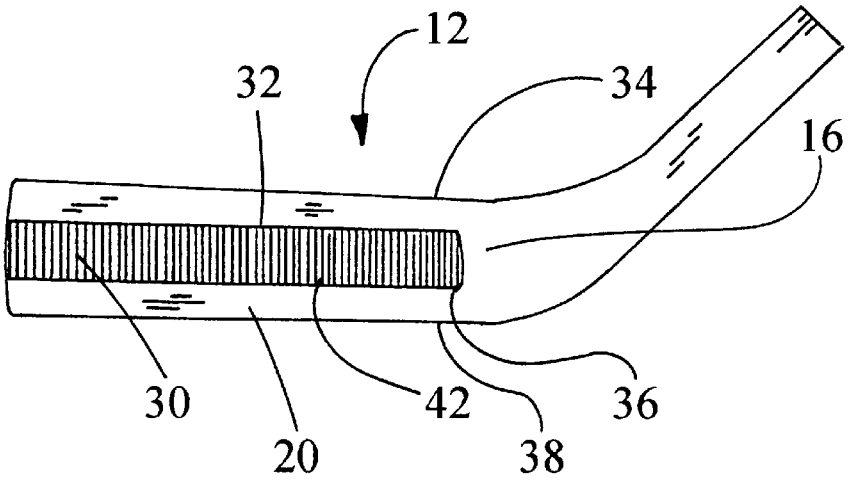
FIG. 10 is a view in rear elevation of the street hockey blade of FIG. 9.

A still further embodiment of the invention is depicted in front and rear elevation in FIGS. 9 and 10 respectively. In this embodiment, as FIG. 9 shows, the horizontal arcuate channel 24 on the first striking face 18 has upper and lower edges 26 and 28 that are displaced respectively from the upper and lower edges 27 and 29 of the first striking face 18. Similarly, as FIG. 10 shows, the horizontal arcuate channel 30 on the second striking face 20 has upper and lower edges 32 and 36 that are displaced respectively from the upper and lower edges 34 and 38 of the second striking face 20. Most preferably, the horizontal arcuate channels 24 and 30 will have horizontal centerlines that are displaced from the lower edges 29 and 38, and thus from a playing surface (not shown), a distance that approximates the radius of a standard street hockey ball (approximately 1.3 inches). With this, the horizontal arcuate channels 24 and 30 will tend to cradle a street hockey ball during hockey play to allow for greater performance characteristics, including ball control. Advantageously, however, by being provided only where the first and second striking faces 18 and 20 are most likely to contact a hockey ball, the arcuate channels 24 and 30 accomplish their functions without unduly compromising the strength and rigidity of the hockey blade 12.

However, still greater control over a game projectile is provided by the embodiment of the invention shown in FIGS. 9 and 10 by the inclusion of vertical score lines 42 in the horizontal arcuate channels 24 and 30. One will appreciate that the vertical score lines 42 are essentially anti-ridges since they comprise depressions below the surfaces of the first and second striking faces 18 and 20 whereas the ridges of the prior art jut above the surfaces of a striking face on which they are disposed. In certain embodiments, the anti-ridge nature of the vertical score lines 42 will be accentuated in that they will comprise depressions of V-shaped cross section into the first and second striking faces 18 and 20. As one can see, the vertical score lines 42 do not extend over the entire first and second striking faces 18 and 20. Instead, the vertical score lines 42 are disposed only in the arcuate channels 24 and 30. As the figures show, the vertical score lines 42 are closely spaced along the arcuate channels 24 and 30 to ensure that a hockey ball 100 that is struck with the hockey blade 12 will contact and feel the effects of at least one, and in all likelihood a plurality, of vertical score lines 42. Although the spacing of the vertical score lines could vary within the scope of the invention, preferred embodiments will space vertical score lines 42 not more than approximately ¼ inch from one another, and more preferable embodiments will space the score lines 42 approximately ⅛, 1/16, or even just 1/32 inch apart.

The portions of the first and second striking faces 18 and 20 not comprising the arcuate channels 24 and 30 are generally smooth. With this, a number of advantages are gained. For example, stress concentrations and other mechanical disadvantages that could arise by having the vertical score lines 42 communicating over the entire first and second striking faces 18 and 20 are minimized. Furthermore, the manufacture of the street hockey blade 12 can be simplified by not requiring the creation of vertical score lines over the entire striking faces 18 and 20. One will again appreciate that the vertical score lines 42 could be formed in a number of ways including being molded into the street hockey blade 12. Alternatively, they could be carved out of the street hockey blade 12 in a separate manufacturing step.

From the foregoing, one skilled in the art will realize that the present invention for a street hockey blade 12 is particularly adapted for use with a spherical street hockey ball 100 and for the environment and circumstances under which street hockey sticks are used. As a result, the street hockey blade 12 achieves a multiplicity of advantages over prior art hockey stick blades. For example, with the provision of first and second arcuate channels 24 and 30, the hockey blade 12 improves a hockey player's ability to stop and control a hockey ball 100 as the hockey ball 100 is cupped and controlled and the hockey blade 12 simulates the activity of a vertically-curved snowplow blade producing a wave of snow. Additionally, the vertical score lines 42 further improve a player's control by allowing the player to induce a lateral spin in a hockey ball 100. Still further, since they are essentially anti-ridges, the vertical score lines 42 advantageously do not tend to inflict damage on a street hockey ball 100 and to not diminish a player's ability to shoot and pass accurately. Also, a hockey player can employ the first and second light sources 44 and 46 to attract attention to the hockey player's hockey stick 10 selectively or automatically upon impact of the stick 10 with an outside object. Furthermore, frictional resistance of the hockey blade 12 relative to a playing surface is reduced while the durability of the hockey blade 12 is increased by the provision of the rotatably retained spherical balls 58, which may be removable where a sleeve 64 is employed. Certainly, these and other objects and advantages of the present invention will become obvious to one who reads this specification and reviews the accompanying drawings.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

I claim as deserving the protection of United States Letters Patent:

1. A hockey blade for a hockey stick for striking a game projectile during hockey play, the hockey blade comprising:

an elongate projectile striking member with a first striking face defined by a first striking face upper edge and a first striking face lower edge and a second striking face with a second striking face upper edge and a second striking face lower edge;

a substantially horizontal first arcuate channel defined by a first arcuate channel upper edge and a first arcuate channel lower edge disposed on at least a portion of the first striking face wherein the first arcuate channel upper edge is spaced from the first striking face upper edge and wherein the first arcuate channel lower edge is spaced from the first striking face lower edge; and a plurality of score lines disposed on the first striking face wherein the plurality of score lines are disposed only in the substantially horizontal first arcuate channel.

2. The hockey blade of claim 1 wherein the plurality of score lines disposed in the first arcuate channel are generally vertical.

3. The hockey blade of claim 2 wherein the plurality of score lines are spaced approximately ¼ inch apart or less.

4. The hockey blade of claim 2 wherein the plurality of score lines are spaced approximately 1/16 inch apart or less.

5. The hockey blade of claim 2 wherein the plurality of score lines are spaced approximately 1/32 inch apart or less.

6. The hockey blade of claim 1 further comprising a substantially horizontal second arcuate channel disposed on at least a portion of the second striking face wherein the second arcuate channel is defined by a second arcuate channel upper edge and a second arcuate channel lower edge.

7. The hockey blade of claim 6 further comprising a plurality of score lines disposed on the second striking face.

8. The hockey blade of claim 1 wherein the projectile striking member is substantially straight.

9. The hockey blade of claim 1 wherein the projectile striking member is horizontally curved whereby the projectile striking member has a concave side and a convex side.

10. The hockey blade of claim 9 wherein the first striking face comprises the concave side of the projectile striking member and wherein the second striking face comprises the convex side of the projectile striking member.

11. The hockey blade of claim 1 further comprising a hockey stick handle.

12. A hockey blade for a hockey stick for striking a game projectile during hockey play, the hockey blade comprising:

an elongate projectile striking member with a first striking face defined by a first striking face upper edge and a first striking face lower edge and a second striking face with a second striking face upper edge and a second striking face lower edge;

a substantially horizontal first arcuate channel defined by a first arcuate channel upper edge and a first arcuate channel lower edge disposed on at least a portion of the first striking face;

a plurality of score lines disposed on the first striking face wherein the plurality of score lines are disposed only in the substantially horizontal first arcuate channel;

a substantially horizontal second arcuate channel disposed on at least a portion of the second striking face wherein the second arcuate channel is defined by a second arcuate channel upper edge and a second arcuate channel lower edge wherein the second arcuate channel upper edge is spaced from the second striking face upper edge and wherein the second arcuate channel lower edge is spaced from the second striking face lower edge; and a plurality of score lines disposed on the second striking face.

13. The hockey blade of claim 12 wherein the plurality of score lines on the second striking face are disposed only in the second arcuate channel.

14. The hockey blade of claim 13 wherein the plurality of score lines disposed in the second arcuate channel are generally vertical.

* * * * *